US005979745A

United States Patent [19]

Surlina

[11] Patent Number: 5,979,745

[45] Date of Patent: Nov. 9, 1999

[54] FOLDED SHEET PACKING

[76] Inventor: Zoran Surlina, Kandlgasse 29, 1070 Wien, Austria

[21] Appl. No.: 09/016,705

[22] Filed: Jan. 30, 1998

[51] Int. Cl.[6] ..... B65D 5/10

[52] U.S. Cl. ..... 229/106; 229/116.1; 229/128; 229/155

[58] Field of Search ..... 229/106, 116.1, 229/117.21, 117.24, 117.25, 117.26, 128, 155

[56] References Cited

U.S. PATENT DOCUMENTS

| | | | |
|---|---|---|---|
| 667,634 | 2/1901 | Schmidt | 229/106 |
| 1,093,705 | 4/1914 | LaBombarde | 229/155 |
| 1,869,742 | 8/1932 | Edmunds | 229/155 |
| 2,596,087 | 5/1952 | Shoudy | 229/155 |
| 3,411,692 | 11/1968 | Mathews | 229/106 |
| 3,765,594 | 10/1973 | Cramphorn | 229/106 |
| 3,971,503 | 7/1976 | Allan et al. | 229/128 |
| 4,388,993 | 6/1983 | Lavery | 229/155 |
| 4,706,874 | 11/1987 | Reil | 229/106 |

FOREIGN PATENT DOCUMENTS

| | | | |
|---|---|---|---|
| 1539381 | 9/1968 | France | 229/155 |
| 700741 | 12/1953 | United Kingdom | 229/155 |
| 2256997 | 6/1973 | United Kingdom | 229/117.26 |

*Primary Examiner*—Gary E. Elkins
*Attorney, Agent, or Firm*—Herbert L. Lerner; Laurence A. Greenberg; Werner H. Stemer

[57] ABSTRACT

A packing for bottles and the like has a flat base surface on which the packing is supported in a standing position. A jacket wall surface connects the base to a cover. In contrast with the base, which has three, four, or more defined corners, the cover surface is rounded, i.e., lens-shaped, elliptical, or circular.

10 Claims, 2 Drawing Sheets

FOLDED SHEET PACKING

BACKGROUND OF THE INVENTION

FIELD OF THE INVENTION

The invention relates to packing with a level base surface, a jacket surface, and a cover surface.

Cuboid packing boxes are well known in the art. The base surface and the cover surface are square or rectangular and the boxes are distinguished in that the entire packing can be stamped from a single piece of carton. Such packing boxes are not optically appealing and they lack all originality. These features, however, are very important in sales and display systems.

Cylindrical packing boxes are also well known. They have circular base and a circular cover surface. The base and cover walls must be produced separately and then they must be attached to the jacket surface. Their appearance is substantially more exciting and appealing.

Finally, packing boxes have been known with base and cover surfaces which are formed on the jacket surface; this, however, results in a domed base and cover surface and the packing box cannot be stood on its base or cover surface.

Instead, it must be laid on its jacket surface. This is particularly disadvantageous for packed goods which should not be stored lying down, even though the outer design appearance of the packing is original and pleasing and thus exhibits particular utility in that respect.

SUMMARY OF THE INVENTION

It is accordingly an object of the invention to provide a folded sheet packing, which overcomes the above-mentioned disadvantages of the prior art devices and methods of this general type and which provide an optically pleasing packing which nevertheless can be stored and displayed standing on its base surface.

With the foregoing and other objects in view there is provided, in accordance with the invention, a packing, comprising:

a packing body having a substantially flat base with at least three corners, a jacket wall defining a jacket surface connected to and extending substantially orthogonally upward from the flat base, and a cover defining a cover surface connected to the jacket surface, the cover surface having a shape selected from the group consisting of lens-shaped, elliptical, and circular.

The objects of the invention are satisfied, therefore, with a base surface with three of more corners, and a cover surface which is lens-shaped, elliptical, or circular.

In accordance with an added feature of the invention, the base is formed of glued-together base tabs integrally formed on the jacket wall. It is preferred for the base to be integral with the jacket surface and to be formed with mutually glued bottom tabs. The packing can be stamped from a single piece of carton or another suitable sheet material (light metal and mixed materials are equally possible).

In accordance with an additional feature of the invention, the cover is formed of at least two wings integrally formed on the jacket wall, and the wings are connected to the jacket wall via a curved fold. The packing is thus properly enabled to stand on its flat base surface, yet it has an optically exciting, original, domed or indented cover surface.

In accordance with another feature of the invention, a central tab is formed onto an edge of one of the wings and two lateral tabs are formed on the same wing laterally of the central tab and/or on the other wing without a central tab. This results in a closure between the two wings so that the packing cannot be accidentally opened.

In accordance with a concomitant feature of the invention, there are strips formed on the jacket wall respectively between the wings. The strips may form a handle of the packing, they may be formed with opening so that a carrying string may be laced therethrough, or some other handle may be attached to the strips. The packing and its contents can thus easily be carried and the handle as well as the carrying string can also be viewed as an additional embellishment of the packing.

Other features which are considered as characteristic for the invention are set forth in the appended claims.

Although the invention is illustrated and described herein as embodied in a folded sheet packing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
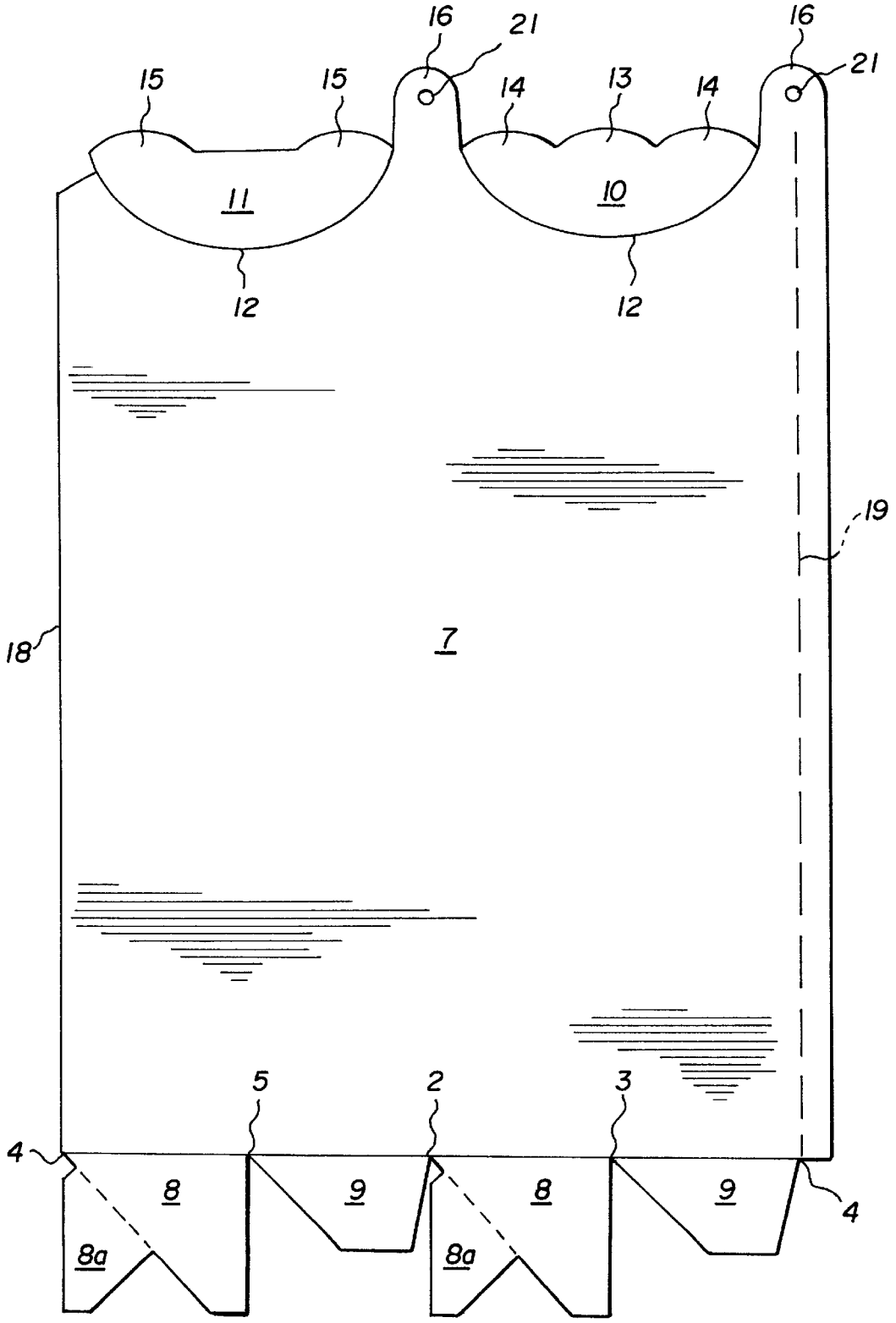
FIG. 1 is a plan view of a packing sheet after cutting and before folding assembly.

Referring now to the figures of the drawing in detail and first, particularly, to FIG. 1 thereof, there is seen a stamp-cut packing sheet defining a jacket wall 7 (defining a jacket surface 7) onto which there are formed base tabs 8, 9 and wings 10, 11. Segments 8*a* of the tabs 8 are glued onto the tabs 9 for forming a base of the packing with a substantially flat base surface. The result, after folding and gluing, is a square base surface with four corners 2, 3, 4, 5. Upon folding, an edge 18 of the jacket surface 7 comes to lie along an imaginary line 19 at the opposite free edge along the longitudinal extent of the packing sheet. The packing is then glued along the long tab defined between the line 19 and the right-hand side edge in FIG. 1.

The wings 10, 11 are connected to the jacket surface 7 via respective curve-shaped folds 12. The edges of the wings 10, 11 distal from the curve-shaped folds 12 have lateral tabs 14, 15 integrally formed thereon. Additionally, the wing 10 has a central tab 13.

The assembled (glued) packing is closed as follows: One of the wings is folded inwardly towards the center. The other wing is folded over it until the tab 13 snaps into the wing 11. If, after the inward folding, the tabs 14 lie on top, then the tab 13 is pushed into the packaging (downward). If the wings 15 lie on top, then the tab 13 is pushed upwardly.

Figure 2:
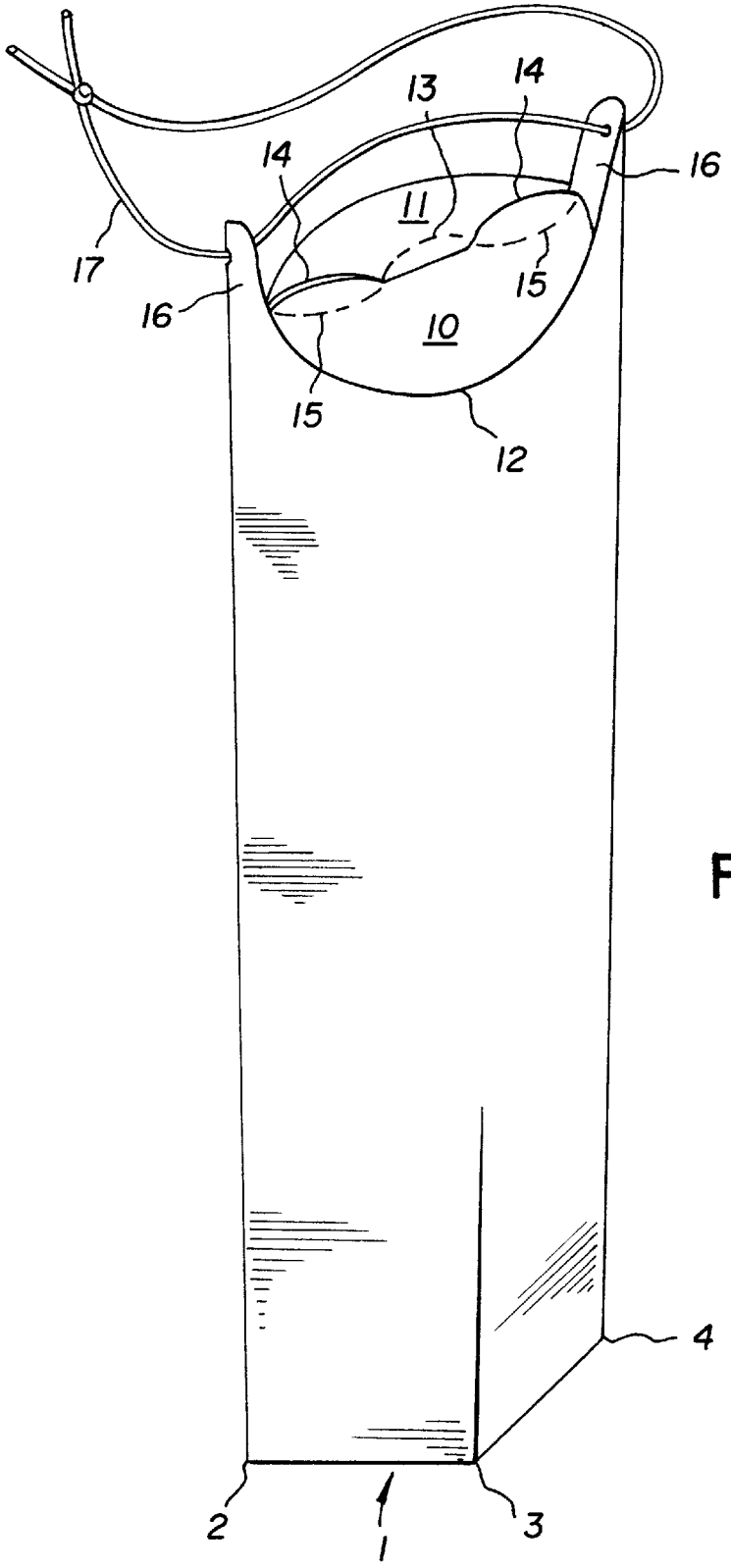
FIG. 2 is a top perspective view after the sheet of FIG. 1 has been folded and glued.

Strips 16 are formed between the wings 10, 11. The strips 16 are formed with a circular opening 21 through which a carrier string 17 may be laced, as illustrated in FIG. 2. In the final assembled form the packing has the shape of a square-base cube at its base and the shape of an eliptical or lens-shaped cylinder at its top.

The packing shown in the illustrated example is suitable, for instance, for packing bottles, such as wine bottles, champagne bottles, and similar articles. The packing is attractive and original, yet it can properly stand on its base surface 1.

I claim:

1. A packing, comprising:

a packing body having a substantially flat base with at least three corners, a jacket wall defining a jacket surface connected to and extending substantially orthogonally upward from said flat base, and a cover defining a cover surface connected to said jacket surface, said base, said jacket wall and said cover being integrally formed of a single packing sheet, said cover comprising at least two wings integrally formed opposite one another on said jacket wall, each of said at least two wings having an edge distally of said jacket wall, said edges of said wings engaging into and facing one another when said wings are folded to close said cover, and said cover surface having a shape selected from the group consisting of lens-shaped, elliptical, and circular.

2. The packing according to claim 1, wherein said base is formed of glued-together base tabs integrally formed on said jacket wall.

3. The packing according to claim 1, wherein said cover is formed of at least two wings integrally formed on said jacket wall, and said wings and said jacket wall are connected via a curved fold.

4. The packing according to claim 3, which further comprises a central tab formed onto an edge of one of said wings and two lateral tabs formed on said one wing laterally of said central tab.

5. The packing according to claim 4, which further comprises two lateral tabs formed on another of said at least two wings.

6. The packing according to claim 3, which further comprises a central tab formed onto an edge of one of said wings and two lateral tabs formed on another of said at least two wings.

7. The packing according to claim 3, which further comprises a plurality of strips formed on said jacket wall respectively between said wings.

8. The packing according to claim 7, wherein said strips form a handle of said packing.

9. The packing according to claim 7, wherein each of said strips has an opening formed therein through which a carrying string is laced.

10. The packing according to claim 7, wherein said strips are provided for attaching thereto a handle for said packing.

* * * * *